US009706854B1

(12) United States Patent
Zhou

(10) Patent No.: US 9,706,854 B1
(45) Date of Patent: Jul. 18, 2017

(54) MULTI-USE BABY CRIB

(71) Applicant: SUZHOU HIGH-TEN SPORTS EQUIPMENT CO., LTD, Zhangjiagang (CN)

(72) Inventor: Jie Zhou, Zhangjiagang (CN)

( * ) Notice: Subject to any disclaimer, the term of this patent is extended or adjusted under 35 U.S.C. 154(b) by 0 days.

(21) Appl. No.: 15/205,913

(22) Filed: Jul. 8, 2016

(30) Foreign Application Priority Data

Mar. 11, 2016 (CN) ..... 2016 1 0137125

(51) Int. Cl.

| | |
|---|---|
| ***A47D 7/00*** | (2006.01) |
| ***A47D 13/06*** | (2006.01) |
| ***A47D 11/00*** | (2006.01) |
| ***A63B 5/11*** | (2006.01) |
| ***A47D 9/00*** | (2006.01) |

(52) U.S. Cl.
CPC ..... *A47D 11/005* (2013.01); *A47D 7/005* (2013.01); *A47D 9/00* (2013.01); *A47D 13/06* (2013.01); *A63B 5/11* (2013.01)

(58) Field of Classification Search
CPC ..... A47D 7/00; A47D 7/002; A47D 7/005; A47D 7/04; A47D 9/00; A47D 9/005; A47D 13/00; A47D 13/06; A47D 13/061; A47D 13/063
USPC ..... 5/93.2, 93.1, 95, 97, 98.1, 99.1, 655
See application file for complete search history.

(56) References Cited

U.S. PATENT DOCUMENTS

| | | | | | |
|---|---|---|---|---|---|
| 3,165,760 | A * | 1/1965 | Abajian | A47D 7/002 | 5/97 |
| 4,900,011 | A * | 2/1990 | Nolet | A47D 13/063 | 482/29 |
| 5,553,336 | A * | 9/1996 | Mariol | A47D 13/06 | 5/93.1 |
| 5,845,349 | A * | 12/1998 | Tharalson | A47D 7/04 | 5/93.1 |
| 6,067,676 | A * | 5/2000 | Carnahan | A47D 13/06 | 135/116 |
| 6,131,218 | A * | 10/2000 | Wang | A47D 13/06 | 5/93.1 |
| 6,148,456 | A * | 11/2000 | Tharalson | A47D 7/04 | 5/95 |
| 6,418,575 | B1 * | 7/2002 | Cheng | A47D 7/002 | 5/93.2 |
| 6,430,762 | B1 * | 8/2002 | Cheng | A47D 7/04 | 5/93.2 |
| 6,434,767 | B1 * | 8/2002 | Welsh, Jr. | A47D 7/04 | 5/99.1 |
| 7,013,505 | B2 * | 3/2006 | Martin | A47D 7/02 | 5/95 |
| D557,510 | S * | 12/2007 | Troutman | D6/331 | |

(Continued)

*Primary Examiner* — Robert G Santos

(57) ABSTRACT

Disclosed herein is a multifunctional crib, which includes a bedstead, a bedplate member and a bouncing member. The bedstead includes an upper enclosure frame, a lower enclosure frame and at least three three-way connectors that connect the upper and lower enclosure frames. The bedplate member is removable and can be installed on the bedstead. The bouncing member is removable and can be installed in a closed area of the lower enclosure frame, which is below the bedplate member. There is bouncing space between the bouncing member and the ground. An exterior protective net is installed outside the periphery of the bedstead. Such a crib can serve as not only a crib, but also a trampoline and game pool, to avoid a waste of resources.

9 Claims, 1 Drawing Sheet

(56) References Cited

U.S. PATENT DOCUMENTS

D566,998 S * 4/2008 Troutman ..... D6/331
7,448,098 B2 * 11/2008 Cheng ..... A47D 7/002 5/93.1
7,568,242 B2 * 8/2009 Troutman ..... A47D 13/063 5/102
8,490,227 B2 * 7/2013 Troutman ..... A47D 13/063 5/93.1
8,566,988 B2 * 10/2013 Son ..... A47D 7/04 5/690
9,027,180 B2 * 5/2015 Troutman ..... A47D 13/063 5/99.1
9,314,115 B2 * 4/2016 Troutman ..... A47D 13/063
2002/0092094 A1 * 7/2002 Welsh, Jr. ..... A47D 7/04 5/95
2005/0034232 A1 * 2/2005 Martin ..... A47D 7/02 5/95
2006/0000019 A1 * 1/2006 Martin ..... A47D 7/02 5/93.1
2006/0185082 A1 * 8/2006 Casati Troutman . A47D 13/063 5/99.1
2007/0271697 A1 * 11/2007 Martin ..... A47D 7/02 5/99.1
2008/0034497 A1 * 2/2008 Cheng ..... A47D 7/002 5/99.1
2009/0000028 A1 * 1/2009 Wang ..... A47D 13/063 5/93.1
2009/0260155 A1 * 10/2009 Troutman ..... A47D 13/063 5/98.1
2011/0283457 A1 * 11/2011 Son ..... A47D 9/00 5/690
2013/0298326 A1 * 11/2013 Troutman ..... A47D 13/063 5/99.1
2015/0208822 A1 * 7/2015 Troutman ..... A47D 13/063 5/99.1
2016/0045775 A1 * 2/2016 Zhou ..... A63B 5/11 482/27
2016/0183697 A1 * 6/2016 Troutman ..... A47D 13/063 5/99.1

* cited by examiner

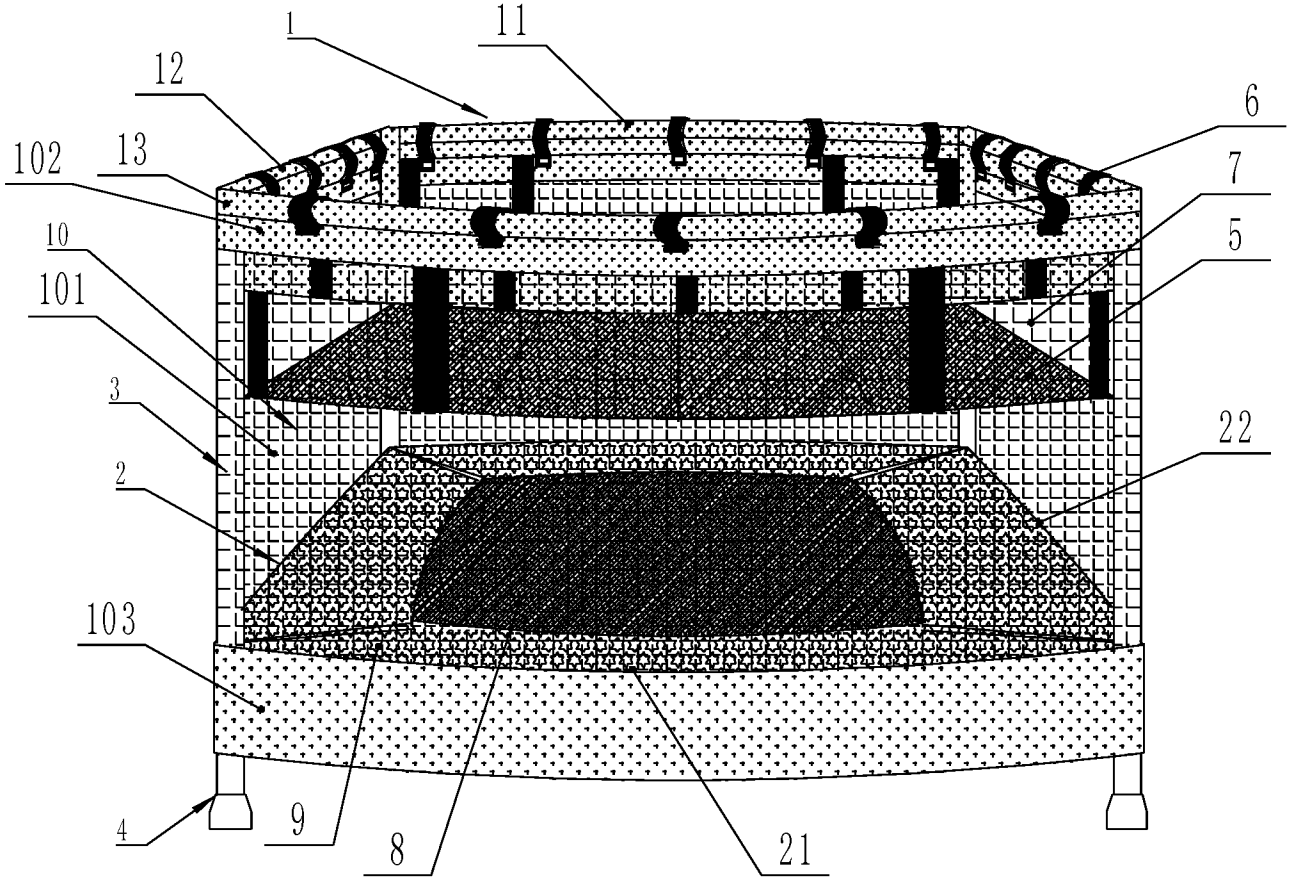
6
7
5
22
11
1
12
13
102
10
101
3
2
103
4
9
8
21

MULTI-USE BABY CRIB

FIELD OF THE INVENTION

The present invention generally relates to a crib, and particularly, to a multi-functional baby crib.

BACKGROUND

Nowadays, baby cribs come with various styles and features and in a wide price range. Although wooden cribs may have achieved the "low-carbon and environment friendly" goal, to some extent they have also caused waste of resources due to the use of non-renewable raw materials and a short service life of the product. Currently, the common sleeping equipment for babies is a cradle or bed, which usually has a simple structure, a single functionality and a boring design. Most families would purchase a crib for their newborn babies, but most of these cribs will not be usable once the children reach two to four years old. This kind of purchase not only increases the burden on the family, but also results in a waste of resources.

SUMMARY OF THE INVENTION

The presently disclosed embodiments are directed to solving issues relating to one or more of the problems presented in the prior art, as well as providing additional features that will become readily apparent by reference to the following detailed description when taken in conjunction with the accompanying drawings.

One objective of the present invention is to provide a multifunctional baby crib, which is designed as not only a baby sleeping bed, but also as a trampoline, so that the waste of resources can be avoided.

In order to solve the above-stated problems, one embodiment of the invention provides a multifunctional crib comprising a bedstead, a bedplate member and a bounce member, wherein the bedstead includes an upper enclosure frame, a lower enclosure frame and at least three three-way connectors connecting the upper and lower enclosure frames, the bedplate member is removable and capable of being installed on the bedstead, the bounce member is removable and capable of being installed in a closed area of the lower enclosure frame and below the bedplate member, and wherein, there is a bouncing space between the bouncing members and the ground, and an exterior protective net is provided around the periphery of the bedstead.

In one preferable embodiment, the bedplate member includes a bedplate body wrapped with a bedplate cloth from the outside, and wherein a bedplate protective net is provided around the bedplate cloth, the bedplate protective net having an upper part that is removable and capable of being installed on the upper enclosure frame through one or more hooks.

In one preferable embodiment, the bedplate body comprises a plurality of side-stitching bedplate units, the bedplate cloth comprises a plurality of bedplate cloth units, each bedplate unit being wrapped in a bedplate cloth unit, and wherein, close to the bottom of the bedplate body, the bedplate cloth is provided with one or more penetrated cloth covers, and inside each penetrated cloth cover is a supporting bar that supports one of the bedplate units.

In one preferable embodiment, the supporting bar comprises at least two rods interconnected with each other.

In one preferable embodiment, the exterior protective net comprises a net body, a fixed cloth cover on the upper end of the net body and a protective skirt on the lower end of the net body, the net body is provided around the bedstead, the protective skirt is provided around the bouncing member, the fixed cloth cover is capable of being removed or fastened through one or more hasps, and one side of the exterior protective net has an opening for people to go through, the opening being operated through a zipper.

In one preferable embodiment, the upper and lower enclosure frames have the same shape, the upper enclosure frame comprises two upper long rails, two upper short rails and four three-way connectors, each upper long rail having an outwardly convex curve, the upper long and short rails are removable and connectable through the three-way connectors, the lower enclosure frame comprises two lower long rails, two lower short rails and four four-way connectors, each lower long rail having an outwardly convex curve, the lower long and short rails are removable and connectable through the four-way connectors, the supporting poles are connected to the three-way connectors on the upper enclosure frame and corresponding four-way connectors on the lower enclosure frame, each four-way connector equipped with a supporting stand.

In one preferable embodiment, the bouncing member comprises a jumping cloth and a resilient component, the resilient component positioned in the outside periphery of the jumping cloth and connecting the jumping cloth and the lower enclosure frame.

In one preferable embodiment, the resilient component comprises an elastic mesh or elastic fabric or a spring, the elastic mesh or elastic fabric comprising a plurality of woven elastic bands or elastic ropes.

In one preferable embodiment, the bedstead is made of metal piles or wood or plastic.

With the above-described technical solution, the invention provides the following benefits:

Because this multifunctional crib comprises a bedstead, a bedplate member and a bounce member, wherein the bedstead includes an upper enclosure frame, a lower enclosure frame and at least three three-way connectors connecting the upper and lower enclosure frames, the bedplate member is removable and capable of being installed on the bedstead, the bounce member is removable and capable of being installed in a closed area of the lower enclosure frame and below the bedplate member, and wherein, there is a bouncing space between the bouncing members and the ground, and an exterior protective net is provided around the bedstead, the crib can be used as a normal crib during the infancy stage, where a baby can sleep on the bedplate member, and the space between the bedplate and bouncing members can be used as storage space, and furthermore, when the baby grows into a child, the bedplate member can be removed from the bedstead so that the child can stand and jump on the bouncing member, using the crib as a trampoline or game pool, in which case the upper enclosure frame and exterior protective net provide additional protection. Therefore, the crib according to embodiments of the invention can be used as a baby crib, as well as a trampoline and game pool, which not only avoids a waste of resources, but also meets various needs of kids from different age groups.

Also, because the bedplate member includes a bedplate body wrapped with a bedplate cloth from the outside, a bedplate protective net is provided around the bedplate cloth, and the upper part of the bedplate protective net can be installed on the upper enclosure frame through one or more hooks, this makes it very easy to assemble or dissemble the crib. The bedplate member can also be used as a cradle.

In addition, the bedplate body comprises a plurality of side-stitching bedplate units, the bedplate cloth comprises a plurality of bedplate cloth units, each bedplate unit being wrapped in a bedplate cloth unit, and close to the bottom of the bedplate body, the bedplate cloth is provided with one or more penetrated cloth covers, and inside each penetrated cloth cover is a supporting bar that supports one of the bedplate units. Such configuration provides a removable and foldable bedplate body, which makes it easy to transport or store the crib.

Moreover, in this crib, the upper and lower enclosure frames have the same shape, the upper enclosure frame comprises two upper long rails, two upper short rails and four three-way connectors, each upper long rail having an outwardly convex curve, the upper long and short rails are removable and connectable through the three-way connectors, the lower enclosure frame comprises two lower long rails, two lower short rails and four four-way connectors, each lower long rail having an outwardly convex curve, the lower long and short rails are removable and connectable through the four-way connectors, the supporting poles are connected to the three-way connectors on the upper enclosure frame and corresponding four-way connectors on the lower enclosure frame, each four-way connector equipped with a supporting stand. Such configuration allows for an easy assembly process for the crib. Because the upper and lower enclosure frames provide an almost rectangular structure, and both the upper and lower long rails have outwardly convex curves, the overall strength of the upper and lower enclosure frames is increased, which meets the use requirement as a trampoline for kids to jump on it.

Further features and advantages of the present disclosure, as well as the structure and operation of various embodiments of the present disclosure, are described in detail below with reference to the accompanying drawings.

BRIEF DESCRIPTION OF THE DRAWINGS

The present disclosure, in accordance with one or more various embodiments, is described in detail with reference to the following FIGURES. The drawings are provided for purposes of illustration only and merely depict exemplary embodiments of the disclosure. These drawings are provided to facilitate the reader's understanding of the disclosure and should not be considered limiting of the breadth, scope, or applicability of the disclosure. It should be noted that for clarity and ease of illustration these drawings are not necessarily made to scale.

FIG. 1 is a schematic view of an exemplary baby crib according to embodiments of the invention, including, among other things, an upper enclosure frame 1, upper long rails 11, upper short rails 12, a three-way connector 13; a lower enclosure frame 2, lower long rails 21, lower short rails 22; supporting poles 3; supporting foot stands 4; a bedplate body 5; hooks 6; a bedplate protective net 7; a jumping cloth 8; a resilient component 9; an exterior protective net 10, a net body 101, a fixed cloth cover 102, and a protective skirt 103.

DETAILED DESCRIPTION OF EXEMPLARY EMBODIMENTS

The following description is presented to enable a person of ordinary skill in the art to make and use the invention. Descriptions of specific devices, techniques, and applications are provided only as examples. Various modifications to the examples described herein will be readily apparent to those of ordinary skill in the art, and the general principles defined herein may be applied to other examples and applications without departing from the spirit and scope of the invention. Thus, embodiments of the present invention are not intended to be limited to the examples described herein and shown, but is to be accorded the scope consistent with the claims.

As shown in FIG. 1, a multifunctional baby crib includes a bedstead, a bedplate member and a bounce member. The bedstead includes an upper enclosure frame 1, a lower enclosure frame 2, and at least three supporting poles 3 that connect the upper enclosure frame 1 and the lower enclosure frame 2. The bedplate member is removable and can be installed on the bedstead. The bouncing member is removable and can be installed in a closed area of the lower enclosure frame 2, which is positioned below the bedplate member. There is bouncing space between the bouncing member and the ground. Also, an exterior protective net is installed around the periphery of the bed frame. More specifically, the exterior protective net 10 can be placed either outside or inside of the bedstead.

In one embodiment, the upper enclosure frame 1 and the lower enclosure frame 2 have the same shape. Preferably, the upper enclosure frame 1 and the lower enclosure frame 2 are almost rectangular. In other embodiments, certainly, the upper enclosure frame 1 and the lower enclosure frame 2 can also be elliptical, circular or polygonal. In view of the crib functionality, the nearly rectangular shape is preferred in practice. The reason that the shape is close to rectangular is because both the upper long rails 11 and lower long rails 21 have outwardly convex curves. In this configuration, the force from either the bedplate member or the bouncing member towards the upper enclosure frame 1 and the lower enclosure frame 2 is directed to the inside, and as such, the upper enclosure frame 1 and the lower enclosure frame 2 can gain increased strength and become less subject to deformation. The upper enclosure frame 1 includes two upper long rails 11, two upper short rails 12 and four three-way connectors 13. In one embodiment, the two upper long rails 11 have outwardly convex curves. The upper long rails 11 and short rails 12 are removable and can be connected via the three-way connectors 13. The lower enclosure frame 21 includes two lower long rails 21, two lower short rails 22 and four four-way connectors. The lower long rails 21 have outwardly convex curves. The lower long rails 21 and lower short rails 22 are removable and can be connected via the four-way connectors. The support poles 3 are connected to the three-way connectors 13 on the upper enclosure frame 1 and the four-way connectors on the lower enclosure frame 2. The four-way connectors on the lower enclosure frame 2 are installed with supporting foot stands 4. The upper enclosure frame 1, lower enclosure frame 2 and three-way connectors 13 can be made of metal pipes to be assembled. The material of the bedstead can also be wood or plastics.

When the bedstead is made of wood, the bedplate member can be fixed and installed on the three-way connectors 3 through the commonly-used bolts, although this assembly process may be a little complicated. Alternatively, the bedplate member can be assembled by use of the three-way connectors and four-way connectors, in which case the upper enclosure frame 1, lower enclosure frame 2 and three-way connectors 3 are made of metal pipes. Thus, in this embodiment, the bedplate member is fixed directly to the upper enclosure frame 1. Specifically, the bedplate member includes a bedplate body 5 wrapped with the bedplate cloth from the outside, and the bedplate cloth is surrounded by a bedplate protective net 7, the upper part of which is removable and can be installed on the upper enclosure frame 1 through one or more hooks 6. The bedplate protective net 7 can be made of nylon nets for a good support, and for additional support, a number of separately-arranged reinforcing woven strips can be provided in the protective net 7.

For purposes of easy transportation and storage, according to one embodiment of the invention, the bedplate 5 includes a plurality of side-stitching bedplate units, and the bedplate cloth comprises a number of interconnected and independent wrapping cloth units, each bedplate units wrapped inside a separate wrapping cloth unit. Close to the bottom of the bedplate body 5, the bedplate cloth is provided with a plurality of penetrated cloth covers, and inside each cloth cover is a supporting bar that supports at least a bedplate unit. As shown in FIG. 1, in one embodiment, there are three bedplate units disposed side by side in the longitudinal direction, and the support bars are positioned below the bedplate units to provide support from under, where the axial direction of the support bars is in parallel with the longitudinal direction of the crib. Each support bar comprises at least two rods interconnected with each other. As such, when the crib is dissembled, the bedplate body 5 can be folded, which reduces the storage space and makes it easy to transport.

In addition, the bouncing member includes a jumping cloth 8 and a resilient component 9. The resilient component 9 is disposed at the outside periphery of the jumping cloth, connecting the jumping cloth 8 with the lower enclosure frame 2. In one embodiment, the resilient component 9 is an elastic mesh or elastic fabric, which is made of a number of woven elastic bands or elastic ropes. Using elastic meshes or fabric can increase the size of the bounce area as well as safety. In other embodiments, the resilient component 9 can be springs, in which case protection cushions are provided around the springs.

As shown in FIG. 1, the exterior protective net 10 includes a net body 101, a fixed cloth cover 102 at the upper end of the net body 101, and a protective skirt 103 at the lower end of the net body 101. The net body 101 is placed around the bedstead. The protective skirt is provided around the bouncing member. The fixed cloth cover 102 is wrapped around the upper enclosure frame 1 and can be removed or fastened through hasps. One side of the exterior protective net 10 has an opening for people to go through, and the opening can be opened or closed through a zipper.

While various embodiments of the invention have been described above, it should be understood that they have been presented by way of example only, and not by way of limitation. Likewise, the various diagrams may depict an example architectural or other configuration for the disclosure, which is done to aid in understanding the features and functionality that can be included in the disclosure. The disclosure is not restricted to the illustrated example architectures or configurations, but can be implemented using a variety of alternative architectures and configurations. Additionally, although the disclosure is described above in terms of various exemplary embodiments and implementations, it should be understood that the various features and functionality described in one or more of the individual embodiments are not limited in their applicability to the particular embodiment with which they are described. They instead can be applied alone or in some combination, to one or more of the other embodiments of the disclosure, whether or not such embodiments are described, and whether or not such features are presented as being a part of a described embodiment. Thus the breadth and scope of the present disclosure should not be limited by any of the above-described exemplary embodiments.

What is claimed is:

1. A multifunctional crib comprising:

a bedstead including an upper enclosure frame, a lower enclosure frame and at least three supporting poles connecting the upper and lower enclosure frames;

a bedplate member that is removable and capable of being installed on the bedstead; and a bounce member that is removable and capable of being installed in a closed area of the lower enclosure frame and below the bedplate member, wherein there is bouncing space between the bouncing member and a surface supporting the crib, and an exterior protective net is provided around the bedstead, and wherein the upper and lower enclosure frames have the same rectangular shape, the upper enclosure frame comprises two upper long rails, two upper short rails and four three-way connectors, each upper long rail having an outwardly convex curve, the upper long and short rails are removable and connectable through the three-way connectors, the lower enclosure frame comprises two lower long rails, two lower short rails and four four-way connectors, each lower long rail having an outwardly convex curve such that force from either the bedplate member or the bouncing member towards the upper and lower enclosure frames is directed to the interior of the crib, and as such, the upper and lower enclosure frames become less subject to deformation, the lower long and short rails are removable and connectable through the four-way connectors.

2. The multifunctional crib of claim 1, wherein the bedplate member includes a bedplate body wrapped with a bedplate cloth from the outside, and wherein a bedplate protective net is provided around the bedplate cloth, the bedplate protective net having an upper part that is removable and capable of being installed on the upper enclosure frame through one or more hooks.

3. The multifunctional crib of claim 2, wherein the bedplate body comprises a plurality of side-stitching bedplate units, the bedplate cloth comprises a plurality of bedplate cloth units, each bedplate unit being wrapped in a bedplate cloth unit, and wherein, close to the bottom of the bedplate body, the bedplate cloth is provided with one or more penetrated cloth covers, and inside each penetrated cloth cover is a supporting bar that supports one of the bedplate units.

4. The multifunctional crib of claim 3, wherein the supporting bar comprises at least two rods interconnected with each other.

5. The multifunctional crib of claim 4, wherein the exterior protective net comprises a net body, a fixed cloth cover on the upper end of the net body and a protective skirt on the lower end of the net body, the net body is provided around the bedstead, the protective skirt is provided around the bouncing member, the fixed cloth cover is capable of being removed or fastened through one or more hasps, and one side of the exterior protective net has an opening for people to go through, the opening being operated through a zipper.

6. The multifunctional crib of claim 1, wherein the supporting poles are connected to the three-way connectors on the upper enclosure frame and corresponding four-way connectors on the lower enclosure frame, each four-way connector equipped with a supporting stand.

7. The multifunctional crib of claim 1, wherein the bouncing member comprises a jumping cloth and a resilient component, the resilient component positioned in the outside periphery of the jumping cloth and connecting the jumping cloth and the lower enclosure frame.

8. The multifunctional crib of claim 7, wherein the resilient component comprises an elastic mesh or elastic fabric or a spring, the elastic mesh or elastic fabric comprising a plurality of woven elastic bands or elastic ropes.

9. The multifunctional crib of claim 1, wherein the bedstead is made of metal piles or wood or plastic.

* * * * *